US005577696A

United States Patent [19]

Kramer

[11] Patent Number: 5,577,696

[45] Date of Patent: Nov. 26, 1996

[54] SMOKE ALARM MOUNT

[76] Inventor: Clarence J. Kramer, Box 141, Eola, Ill. 60519

[21] Appl. No.: 456,300

[22] Filed: Jun. 1, 1995

[51] Int. Cl.[6] ..... A47G 1/17

[52] U.S. Cl. ..... 248/206.5; 248/309.4; 340/628

[58] Field of Search ..... 248/206.5, 205.4, 248/683, 309.4; 340/628

[56] References Cited

U.S. PATENT DOCUMENTS 4,702,452 10/1987 Penar ..... 248/317
4,887,073 12/1989 Nakao et al. ..... 340/628 X
4,896,145 1/1990 Lewkowicz ..... 340/628 X
4,968,975 11/1990 Fritz ..... 340/628
5,149,038 9/1992 VanCleve ..... 248/297.21
5,281,954 1/1994 Harrinson et al. ..... 340/628

FOREIGN PATENT DOCUMENTS 1550652 12/1968 France ..... 248/309.4

*Primary Examiner*—Ramon O. Ramirez

[57] ABSTRACT

A mount for releasably securing a smoke detector to a support surface. The inventive device includes a base plate securable to a wall or ceiling. A magnet receiver mountable to a smoke detector is magnetically coupled to the base plate by a magnet interposed between the base plate and the magnet receiver so as to permit removable coupling of the smoke detector to the support surface.

12 Claims, 3 Drawing Sheets

FIG 3
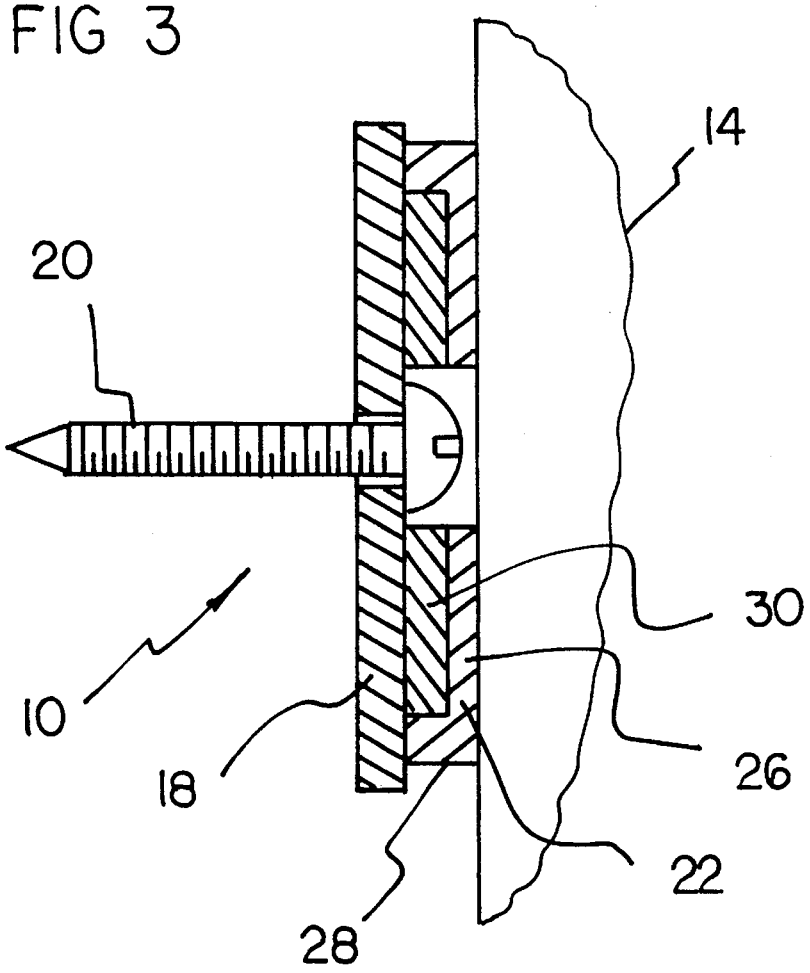
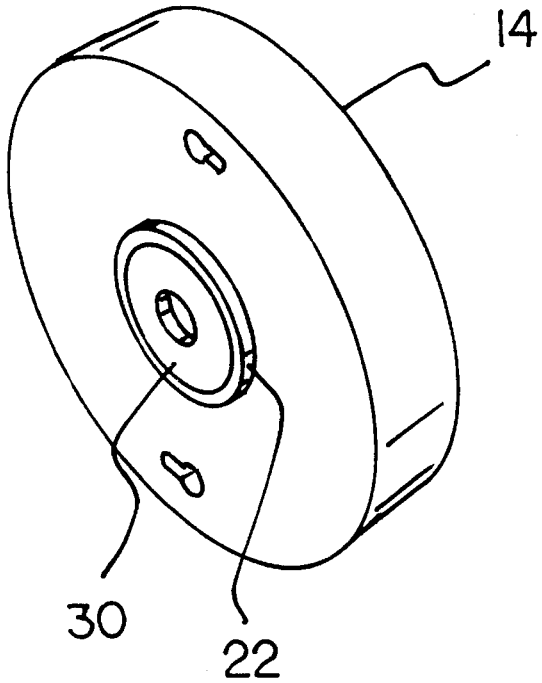
FIG 4

SMOKE ALARM MOUNT

BACKGROUND OF THE INVENTION

1. Field of the Invention

The present invention relates to securing devices and more particularly pertains to a smoke alarm mount for releasably securing a smoke detector to a support surface.

2. Description of the Prior Art

The use of securing devices is known in the prior art. More specifically, securing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art securing devices include U.S. Pat. No. 5,149,038; U.S. Pat. No. 4,702,452; U.S. Pat. No. 5,186,653; U.S. Pat. No. 5,188,332; U.S. Pat. No. 5,153,567; and U.S. Pat. No. Design 246,635.

While these devices fulfill their respective, particular objectives and requirements, the aforementioned patents do not disclose a smoke alarm mount for releasably securing a smoke detector to a support surface which includes a base plate securable to a wall or ceiling, and a magnet receiver mountable to a smoke detector and magnetically coupled to the base plate by a magnet interposed between the base plate and the magnet receiver so as to permit removable coupling of the smoke detector to the support surface.

In these respects, the smoke alarm mount according to the present invention substantially departs from the conventional concepts and designs of the prior art, and in so doing provides an apparatus primarily developed for the purpose of releasably securing a smoke detector to a support surface.

SUMMARY OF THE INVENTION

In view of the foregoing disadvantages inherent in the known types of securing devices now present in the prior art, the present invention provides a new smoke alarm mount construction wherein the same can be utilized for releasably securing a smoke detector to a wall or ceiling. As such, the general purpose of the present invention, which will be described subsequently in greater detail, is to provide a new smoke alarm mount apparatus and method which has many of the advantages of the securing devices mentioned heretofore and many novel features that result in a smoke alarm mount which is not anticipated, rendered obvious, suggested, or even implied by any of the prior art securing devices, either alone or in any combination thereof.

To attain this, the present invention generally comprises a mount for releasably securing a smoke detector to a support surface. The inventive device includes a base plate securable to a wall or ceiling. A magnet receiver mountable to a smoke detector is magnetically coupled to the base plate by a magnet interposed between the base plate and the magnet receiver so as to permit removable coupling of the smoke detector to the support surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new smoke alarm mount apparatus and method which has many of the advantages of the securing devices mentioned heretofore and many novel features that result in a smoke alarm mount which is not anticipated, rendered obvious, suggested, or even implied by any of the prior art securing devices, either alone or in any combination thereof.

It is a further object of the present invention to provide a new smoke alarm mount which is of a durable and reliable construction.

An even further object of the present invention is to provide a new smoke alarm mount which is susceptible of a low cost of manufacture with regard to both materials and labor, and which accordingly is then susceptible of low prices of sale to the consuming public, thereby making such smoke alarm mounts economically available to the buying public.

Still yet another object of the present invention is to provide a new smoke alarm mount which provides in the apparatuses and methods of the prior art some of the advantages thereof, while simultaneously overcoming some of the disadvantages normally associated therewith.

Still another object of the present invention is to provide a new smoke alarm mount for releasably securing a smoke detector to a support surface.

Yet another object of the present invention is to provide a new smoke alarm mount which includes a base plate securable to a wall or ceiling, and a magnet receiver mountable to a smoke detector and magnetically coupled to the base plate by a magnet interposed between the base plate and the magnet receiver so as to permit removable coupling of the smoke detector to the support surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following derailed description thereof. Such description makes reference to the annexed drawings wherein

FIG. 3 is a cross sectional view taken along line 3 of FIG. 1.

FIG. 4 is a rear isometric illustration of a portion of the present invention.

DESCRIPTION OF THE PREFERRED EMBODIMENT

Figure 1:
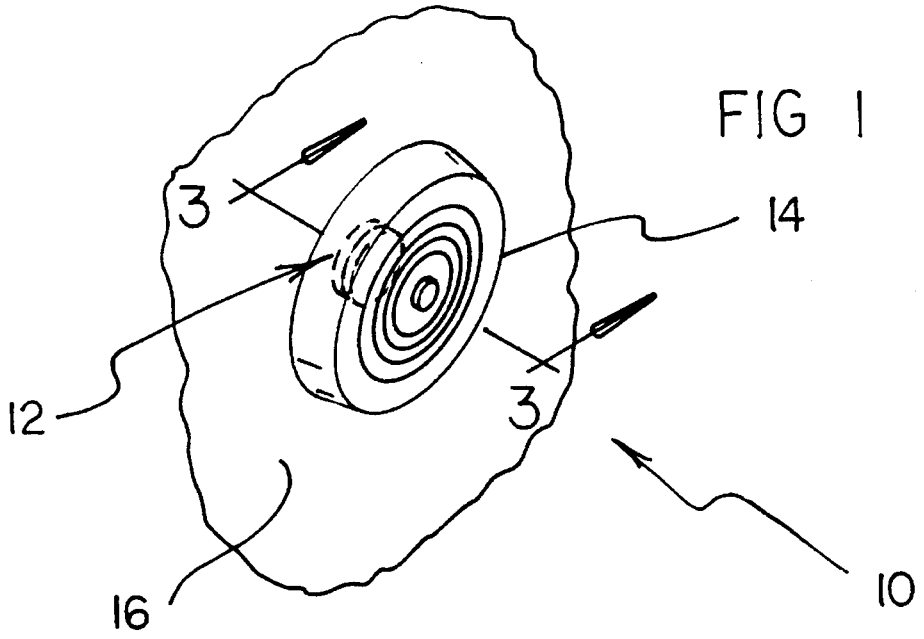
FIG. 1 is an isometric illustration of a smoke alarm mount according to the present invention in use.
Figure 2:
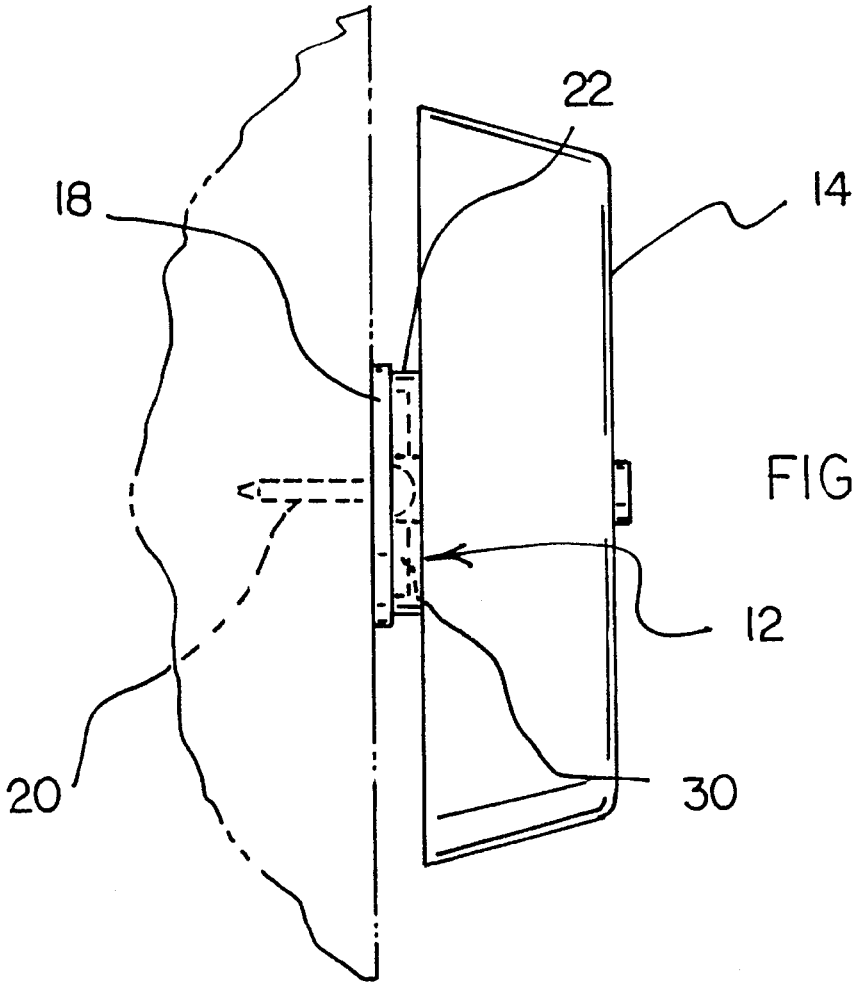
FIG. 2 is a side elevation view of the invention.

With reference now to the drawings, and in particular to FIGS. 1–5 thereof, a new smoke alarm mount embodying the principles and concepts of the present invention and generally designated by the reference numeral 10 will be described.

More specifically, it will be noted that the smoke alarm mount 10 comprises a mounting means 12 for releasably coupling a smoke detector 14 to a support surface 16 such as a wall or ceiling within a building. By this structure, the smoke detector 14 can be selectively decoupled from the support surface 16 to permit an individual to service or silence the smoke detector.

Figure 5:
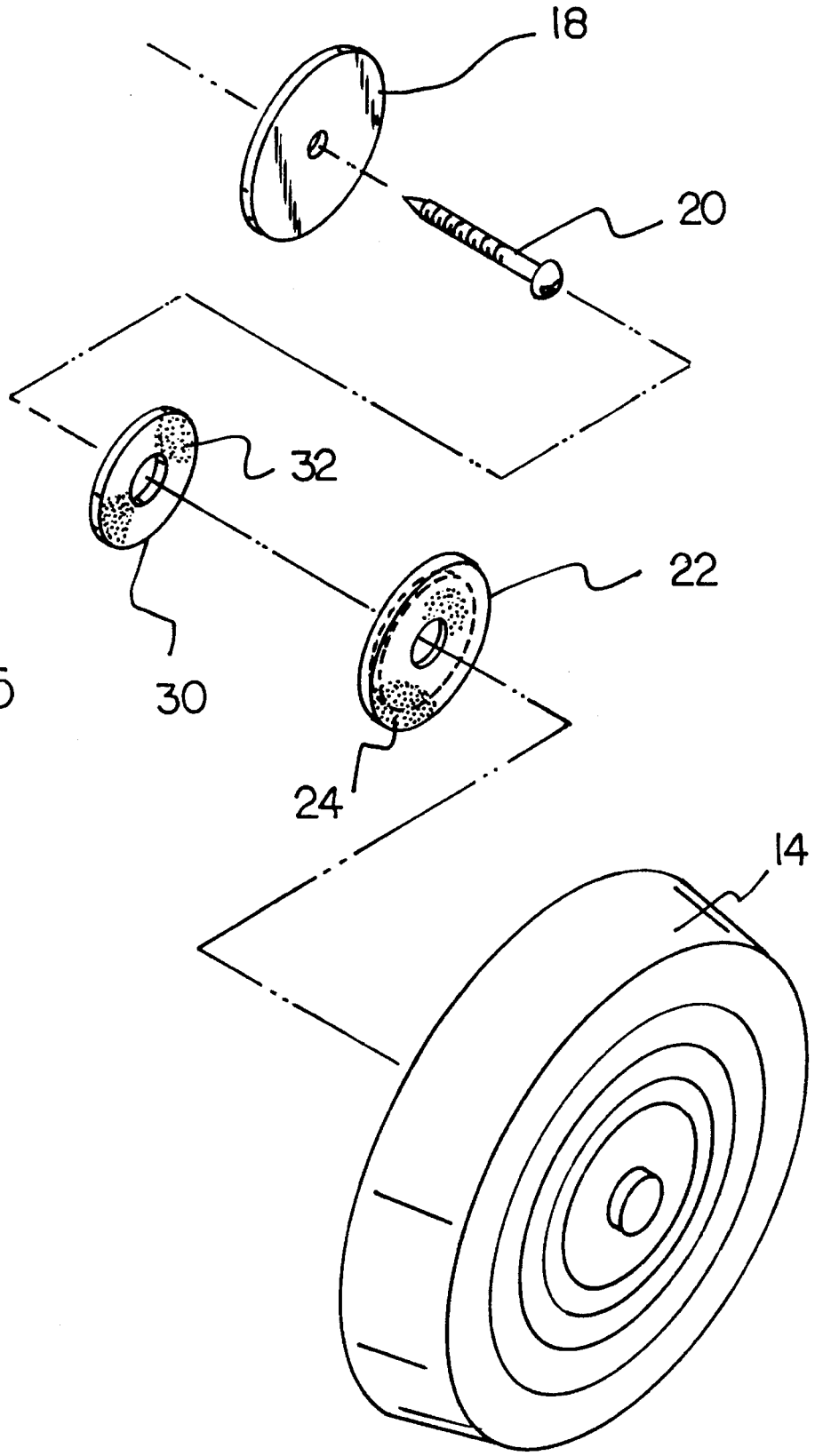

As best illustrated in FIGS. 2 through 5, it can be shown that the mounting means 12 according to the present invention 10 preferably comprises a base plate 18 securable to the support surface 16 by any conventionally known means such as through a use of an adhesive or the like. Preferably, the base plate 18, as shown in FIGS. 3 and 5, includes an unlabeled mounting aperture directed therethrough permitting the passage of a fastener 20 through the base plate 18 for securement into the support surface 16. By this structure the base plate 18 can be selectively secured to a support surface 16 such as a wall or ceiling within a building.

With continuing reference to FIGS. 2 through 5, it can be shown that the mounting means 12 according to the present invention 10 further comprises a magnet receiver 22 securable to a mounting surface of the smoke detector 14. To this end, an adhesive 24 as shown in FIG. 5, can be interposed between the magnet receiver 22 and the rear surface of the smoke detector 14 so as to couple the magnet receiver thereto. Alternatively, the magnet receiver 22 can include a mounting aperture directed therethrough as shown in the drawings permitting selective securement of the magnet receiver to the smoke detector 14 through a passage of an unillustrated fastener through the mounting aperture of the magnet receiver 22. As shown in FIG. 3, the magnet receiver 22 preferably comprises a substantially planar member 26 having a perimeter side wall 28 projecting from an outer periphery of the planar member for purposes which will subsequently be described in more detail.

The mounting means 12, as best illustrated in FIG. 3, still further comprises a magnet 30 interposed between the magnet receiver 22 and the base plate 18 so as to magnetically couple the magnet receiver 22 relative to the base plate 18. To this end, the base plate 18 is preferably comprised of a substantially ferrous material to which the magnet 30 is attracted. Similarly, the magnet receiver 22 is also desirably comprised of a substantially ferrous material attracted to the magnet 30. By this structure, the magnet receiver 22 can be magnetically coupled to the base plate 18 by the magnetic field generated by the magnet 30. Preferably, the magnet 30 is shaped so as to define a central aperture directed therethrough which accommodates a head of the fastener 20 as shown in FIG. 3 of the drawings. The perimeter side wall 28 of the magnet receiver 22 is desirably shaped so as to encompass or receive therebetween the outer periphery of the magnet 30 so as to center the magnet within the magnet receiver 22. By this structure, the magnet 30 can be centered relative to the base plate 18 by the central aperture positioned about the head of the fastener 20, with the magnet receiver 22 being centered relative to the magnet 30 by the perimeter side wall 28 engaging the outer periphery of the magnet.

If desired, either the base plate 18 or the magnet receiver 22 can be constructed of a substantially non-ferrous material, with the magnet 30 being adhesively or mechanically secured to either the base plate 18 or the magnet receiver 22, respectively. To this end, the magnet 30 may include an adhesive 32 applied thereto which couples the magnet to either the base plate 18 or the magnet receiver 22. Preferably, the base plate 18 is constructed of the ferrous material, with the magnet receiver 22 being constructed of any desired material and the magnet 30 being secured within the magnet receiver 22 by the adhesive 32 interposed therebetween.

In use, the smoke alarm mount 10 according to the present invention can be easily utilized to effect removable coupling of a smoke detector 14 relative to a support surface 16 within a building structure or the like. The present invention 10 allows an individual to selectively decouple the smoke detector 14 from the support surface so as to effect servicing of the smoke detector and/or silencing of the smoke detector due to a false alarm such as can be caused by cigarette smoke or smoke generated from cooking appliances within the home.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the pans of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown anti described, and accordingly, all suitable modifications and equivalents may be resorted to, falling within the scope of the invention.

What is claimed as being new and desired to be protected by LETTERS PATENT of the United States is as follows:

1. A smoke alarm mount comprising:

a smoke detector;

a mounting means for releasably coupling the smoke detector to a support surface, the mounting means comprises a base plate securable to the support surface; a magnet receiver secured to the smoke detector; a magnet interposed between the magnet receiver and the base plate so as to magnetically couple the magnet receiver relative to the base plate, the base plate is shaped so as to define a mounting aperture directed therethrough; and further comprising a fastener directed through the mounting aperture and securable to a support surface so as to permit coupling of the base plate to a support surface.

2. The smoke alarm mount of claim 1, wherein the fastener includes a fastener head; and further wherein the magnet is shaped so as to define a central aperture directed therethrough which accommodates the head of the fastener.

3. The smoke alarm mount of claim 2, wherein the magnet receiver comprises a substantially planar member having a perimeter side wall projecting from an outer periphery of the planar member, the magnet being received within the perimeter side wall.

4. A smoke alarm mount comprising:

a mounting means for releasably coupling a smoke detector to a support surface, the mounting means comprises a base plate securable to the support surface; a magnet receiver secured to a smoke detector; a magnet interposed between the magnet receiver and the base plate, the magnet being adhesively secured to the magnet receiver and magnetically coupled to the base plate, the base plate is shaped so as to define a mounting aperture directed therethrough; and further comprising a fastener directed through the mounting aperture and securable to a support surface so as to permit coupling of the base plate to a support surface.

5. The smoke alarm mount of claim 4, wherein the fastener includes a fastener head; and further wherein the magnet is shaped so as to define a central aperture directed therethrough which accommodates the head of the fastener.

6. The smoke alarm mount of claim 5, wherein the magnet receiver comprises a substantially planar member having a perimeter side wall projecting from an outer periphery of the planar member, the magnet being received within the perimeter side wall.

7. A smoke alarm mount comprising:

a smoke detector;

a mounting means for releasably coupling the smoke detector to a support surface, the mounting means comprises a base plate securable to the support surface; a magnet receiver secured to the smoke detector; a magnet interposed between the magnet receiver and the base plate, the magnet being adhesively secured to the magnet receiver and magnetically coupled to the base plate, the base plate is shaped so as to define a mounting aperture directed therethrough; and further comprising a fastener directed through the mounting aperture and securable to a support surface so as to permit coupling of the base plate to a support surface.

8. The smoke alarm mount of claim 7, wherein the fastener includes a fastener head; and further wherein the magnet is shaped so as to define a central aperture directed therethrough which accommodates the head of the fastener.

9. The smoke alarm mount of claim 8, wherein the magnet receiver comprises a substantially planar member having a perimeter side wall projecting from an outer periphery of the planar member, the magnet being received within the perimeter side wall.

10. A smoke alarm mount comprising:

a mounting means for releasably coupling a smoke detector to a support surface, the mounting means comprising a base plate securable to the support surface; a magnet receiver securable to a smoke detector; a magnet interposed between the magnet receiver and the base plate so as to magnetically couple the magnet receiver relative to the base plate, the base plate is shaped so as to define a mounting aperture directed therethrough; and further comprising a fastener directed through the mounting aperture and securable to a support surface so as to permit coupling of the base plate to a support surface.

11. The smoke alarm mount of claim 10, wherein the fastener includes a fastener head; and further wherein the magnet is shaped so as to define a central aperture directed therethrough which accommodates the head of the fastener.

12. The smoke alarm mount of claim 11, wherein the magnet receiver comprises a substantially planar member having a perimeter side wall projecting from an outer periphery of the planar member, the magnet being received within the perimeter side wall.

* * * * *